US010317166B1

(12) United States Patent
Smith

(10) Patent No.: US 10,317,166 B1
(45) Date of Patent: Jun. 11, 2019

(54) RECOIL ABATEMENT STOCK WITH REDUCED RATTLE

(71) Applicant: Vista Outdoor Operations LLC, Anoka, MN (US)

(72) Inventor: Paul N. Smith, Bozeman, MT (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 15/892,000

(22) Filed: Feb. 8, 2018

Related U.S. Application Data

(62) Division of application No. 14/997,016, filed on Jan. 15, 2016, now Pat. No. 9,909,835.

(60) Provisional application No. 62/104,573, filed on Jan. 16, 2015, provisional application No. 62/104,549, filed on Jan. 16, 2015.

(51) Int. Cl.
*F41C 23/08* (2006.01)
*F41C 23/16* (2006.01)

(52) U.S. Cl.
CPC ..... *F41C 23/08* (2013.01); *F41C 23/16* (2013.01)

(58) Field of Classification Search
CPC ..... F41C 23/06; F41C 23/08; F41C 23/16; F41C 23/20
USPC ..... 42/74
See application file for complete search history.

(56) References Cited

U.S. PATENT DOCUMENTS

| | | | | |
|---|---|---|---|---|
| 1,144,285 | A * | 6/1915 | Becker | F41A 19/28 42/25 |
| 1,351,141 | A | 8/1920 | Thompson | |
| 1,964,649 | A | 6/1934 | Stetson | |
| 2,731,753 | A | 1/1956 | Mathieu | |
| 2,754,608 | A | 7/1956 | Stieffel, Jr. | |
| 2,831,404 | A | 4/1958 | Sampson et al. | |
| 3,001,312 | A | 9/1961 | Campbell | |
| 3,039,222 | A | 6/1962 | Hoge | |
| 3,105,411 | A | 10/1963 | Browning | |
| 3,176,424 | A | 4/1965 | Hoge | |
| 3,209,482 | A | 10/1965 | Kuzma et al. | |
| 3,233,354 | A | 2/1966 | Ahearn | |

(Continued)

FOREIGN PATENT DOCUMENTS

| | | |
|---|---|---|
| EP | 1122507 | 4/1991 |
| EP | 1657518 | 5/2006 |
| EP | 229306 B1 | 11/2012 |

OTHER PUBLICATIONS

Givology [online] "The World's Largest Selection of Gun Parts & Accessories for Sale" First Accessed on Nov. 20, 2013. Retrieved from the Internet: http://www.gunaccessories.com/RecoilBuffers (15 pgs.).

Recoil Systems [online] "The ISIS II Recoil reducer is the only unit of its kind and is manufactured in the UK. The unit was developed and patented in 2001 and has sold very successfully throughout the world since" First Accessed on Nov. 20, 2013. Retrieved from the Internet: http://www.recoilsystems.com/principle.asp (2 pgs.).

*Primary Examiner* — Stephen Johnson
(74) *Attorney, Agent, or Firm* — Christensen, Fonder, Dardi & Herbert PLLC

(57) ABSTRACT

A recoil reduction system for a firearm. In some embodiments, the recoil reduction includes buffer tube housed within a buttstock, and a deformable structure for setting a clearance tolerance between the buffer tube and the buttstock to reduce lateral play while enabling smooth translation therebetween. In some embodiments, a guide pin and/or skid projections provide interference between the sliding components of the recoil reduction system when in a battery configuration, while releasing the interference during a recoil event.

19 Claims, 9 Drawing Sheets

(56) References Cited

U.S. PATENT DOCUMENTS 3,405,470 A 10/1968 Wesemann
3,492,749 A 2/1970 Vironda
3,707,797 A 1/1973 Ruth
3,714,726 A 2/1973 Braun
4,112,605 A 9/1978 Staub
4,213,261 A * 7/1980 Claypool ..... F41A 3/40 42/16
4,439,943 A 4/1984 Brakhage
H217 H 2/1987 Jorczak
4,663,876 A 5/1987 Reaume
4,663,877 A 5/1987 Bragg
4,769,937 A 9/1988 Gregory et al.
4,774,873 A 10/1988 Shoales
4,785,922 A 11/1988 Kiehart
4,867,038 A 9/1989 Metz
4,909,129 A * 3/1990 Reynolds ..... F41A 5/18 89/187.01
4,910,904 A * 3/1990 Rose ..... F41C 23/06 42/73
4,986,018 A 1/1991 McDonald, Jr.
5,031,348 A 7/1991 Carey
5,235,764 A 8/1993 Perazzi
5,305,539 A 4/1994 Von Kuster
5,343,649 A 9/1994 Petrovich
5,362,046 A 11/1994 Sims
5,375,360 A 12/1994 Vatterott
5,392,553 A 2/1995 Carey
5,410,833 A 5/1995 Paterson
5,513,730 A 5/1996 Petrovich et al.
D376,188 S 12/1996 Riecken
5,598,904 A 2/1997 Spyche, Jr.
5,634,289 A 6/1997 Wascher
5,669,168 A 9/1997 Perry
5,722,195 A 3/1998 Bentley et al.
5,726,377 A 3/1998 Harris et al.
5,827,992 A 10/1998 Harris et al.
5,909,002 A 6/1999 Atchisson
5,974,718 A 11/1999 Bentley et al.
5,979,098 A 11/1999 Griggs
6,164,002 A 12/2000 Troncoso
6,305,115 B1 10/2001 Cook
6,467,212 B1 10/2002 Apel
6,481,143 B2 11/2002 McCarthy
6,530,563 B1 3/2003 Miller et al.
6,560,911 B2 5/2003 Sharp
6,564,493 B1 5/2003 Forman
6,594,935 B2 7/2003 Beretta
6,637,141 B1 10/2003 Weatherby et al.
6,651,371 B2 11/2003 Fitzpatrick et al.
6,662,485 B2 12/2003 Kay
6,684,547 B2 2/2004 Poff, Jr.
6,688,031 B2 2/2004 Steele
6,732,466 B2 5/2004 Bentley
6,758,126 B1 7/2004 Houtsma
6,761,102 B2 7/2004 Giza
6,834,455 B2 12/2004 Burigana
6,834,456 B2 12/2004 Murello
6,848,351 B1 2/2005 Davies
6,874,267 B2 4/2005 Fitzpatrick et al.
6,889,461 B2 5/2005 Vignaroli et al.
6,976,333 B2 12/2005 Sims
7,025,052 B2 4/2006 Schavone
7,055,277 B2 6/2006 Sims
7,121,032 B2 10/2006 Daul et al.
7,124,529 B1 10/2006 Havelka, Jr.
7,131,367 B1 11/2006 Boerschig et al.
7,152,355 B2 12/2006 Fitzpatrick et al.
7,152,356 B2 12/2006 Sims
7,162,822 B1 1/2007 Heayn et al.
7,273,002 B1 9/2007 Rogers
7,380,487 B2 6/2008 Mantas
7,398,616 B1 7/2008 Weir
7,478,495 B1 1/2009 Alzamora et al.
7,493,845 B2 2/2009 Mantas
7,536,819 B2 5/2009 Popikow
7,581,954 B2 9/2009 Schavone
7,673,413 B2 3/2010 Bentley
7,681,351 B2 3/2010 Bucholtz et al.
7,775,150 B2 8/2010 Hochstrate et al.
7,793,453 B1 9/2010 Sewell, Jr. et al.
7,823,313 B2 11/2010 Faifer
7,827,722 B1 11/2010 Davies
7,849,626 B2 12/2010 Fluhr
7,877,917 B2 * 2/2011 Cinciu ..... F41C 23/06 42/1.06
7,926,216 B2 4/2011 Bentley
7,930,849 B2 4/2011 Abraham et al.
7,938,055 B2 5/2011 Hochstrate et al.
7,963,203 B1 6/2011 Davies
7,966,760 B2 6/2011 Fitzpatrick et al.
7,984,580 B1 7/2011 Giauque et al.
7,992,337 B2 8/2011 Ochoa
8,037,806 B2 10/2011 Davies
8,051,593 B2 11/2011 Vesligaj
8,074,391 B2 12/2011 Petrůj
8,117,958 B2 2/2012 Hochstrate et al.
8,127,483 B2 3/2012 Kincel
8,176,668 B2 5/2012 Simms et al.
8,176,835 B1 5/2012 Cottle
8,205,371 B1 6/2012 Cook et al.
8,286,382 B2 10/2012 Vesligaj
8,296,984 B2 10/2012 Kincel
8,296,986 B1 10/2012 Cook et al.
8,297,175 B1 10/2012 Davies
8,327,569 B2 12/2012 Kincel
8,341,868 B2 1/2013 Zusman
8,356,542 B2 1/2013 Cottle et al.
8,387,297 B2 3/2013 deBrun et al.
8,413,361 B2 4/2013 Quaedpeerds et al.
8,430,015 B2 4/2013 Faifer
8,434,252 B2 5/2013 Holmberg
8,448,562 B2 5/2013 Cottle
8,468,729 B1 6/2013 Sylvester
8,474,169 B2 7/2013 Cottle et al.
8,505,226 B2 8/2013 Vesligaj
8,505,433 B2 8/2013 Hochstrate et al.
8,555,541 B2 10/2013 Ingram
8,561,338 B2 10/2013 Chvala
8,607,687 B2 12/2013 Cottle
8,661,963 B2 3/2014 Patel
8,671,608 B2 3/2014 Vesligaj
8,677,664 B2 3/2014 Caravaggi et al.
8,677,669 B1 3/2014 Vesligaj
8,689,672 B2 4/2014 Cassels
8,707,850 B1 4/2014 Davies
8,720,099 B1 5/2014 Sisk
8,752,472 B1 6/2014 Lukman et al.
8,776,421 B1 7/2014 Vesligaj
8,782,941 B2 7/2014 Zusman
8,783,160 B2 7/2014 Hochstrate et al.
8,800,189 B2 8/2014 Fitzpatrick et al.
8,806,791 B2 8/2014 Cottle
8,815,138 B2 8/2014 Howe et al.
8,844,185 B2 9/2014 Jarboe
8,863,428 B2 10/2014 Vesligaj
8,904,692 B2 12/2014 Ballard
8,943,726 B2 2/2015 Kincel
8,950,098 B2 2/2015 Sims et al.
9,021,727 B2 5/2015 Butler
2005/0246931 A1 11/2005 Poff, Jr.
2007/0089347 A1 4/2007 Webber et al.
2010/0229444 A1 9/2010 Faifer
2010/0251587 A1 10/2010 Kincel
2011/0113666 A1 5/2011 Latimer
2011/0138668 A1 6/2011 Thomas
2012/0174457 A1 7/2012 Edelman
2014/0165443 A1 6/2014 Johnston

* cited by examiner

RECOIL ABATEMENT STOCK WITH REDUCED RATTLE

RELATED APPLICATIONS

This application is a Divisional of U.S. application Ser. No. 14/997,016, filed Jan. 15, 2016, now U.S. Pat. No. 9,909,835, which claims the benefit of U.S. provisional patent application No. 62/104,573, filed Jan. 16, 2015, and U.S. provisional patent application No. 62/104,549, filed Jan. 16, 2015, the disclosures of which are hereby incorporated by reference herein in their entirety.

BACKGROUND

Recoil abatement systems are commonly employed in firearms, ranging from complaint butt pads to spring-loaded or shock dampening components coupled to the buttstock. More recent recoil abatement systems include "sliding stock" systems, featuring components internal to the buttstock that enable the receiver of the firearm to translate within the buttstock. Some stock systems, irrespective of whether they provide recoil abatement, feature the ability to readily adjust the overall length.

Conventional sliding stock and stock length adjustment systems can present undesirable play between the sliding components.

In view of these shortcomings, improvements to sliding stock and stock length adjustment systems that reduce play between the components would be welcomed.

SUMMARY

Recoil reduction system concepts are disclosed that may be utilized with a variety of firearms, such as shot guns and rifles. In some embodiments, the recoil reduction systems are provided as retrofit kits for installation on existing firearms. In other embodiments, the recoil reduction systems are incorporated into factory-supplied firearms.

Various embodiments of the disclosure are directed to a stock length adjustment that enables the length of the stock to be readily adjusted while reducing unwanted looseness or "play" between the adjustable components of the stock. In one embodiment, a one-time adjustment of a deformable structure is utilized to compensate for clearance uncertainties between precision machine components having very tight machining tolerance and molded components having relatively large manufacturing tolerances. The one-time, set-and-forget adjustment can be performed by the user, and tailored to enable translational movement (sliding) between the components while reducing lateral play that causes undesirable rattling between the components.

Various embodiments of the disclosure present a recoil reduction system that reduces unwanted play between the sliding components of the system when the recoil reduction system is in a battery configuration, while enabling free translation between these components during a recoil event when the firearm is discharged. In some embodiments, one or more mechanisms are employed to offset the sliding components relative to each other as the system approaches and is seated in the battery configuration. Upon discharge of the firearm, the sliding components translate to a centered position along an actuation axis to enable free movement therebetween during the recoil stroke, returning to the offset configuration upon reciprocation into the battery configuration.

Structurally, in various embodiments of the disclosure, a recoil reduction system includes a buttstock defining a longitudinal bore, a slide member for coupling to a receiver, a biasing element operatively coupled with the buttstock and the slide member, a butt pad coupled to a proximal end of the buttstock, and a buffer tube disposed in the longitudinal bore. The buttstock includes a deformable structure adapted to selectively reduce a dimension of the longitudinal bore to configure the buttstock for a close sliding fit between the longitudinal bore and the buffer tube.

In various embodiments of the disclosure, a recoil abatement system for a firearm includes a housing, a slide member translatable within the housing along an actuation axis, the slide member being configured for operative coupling to a receiver, a canted guide slot defined on a lateral face of one of the housing and the slide member, the canted guide slot having a first end segment that is canted relative to the actuation axis, and a guide pin extending laterally from the other of the housing and the slide member. The guide pin extends into the canted guide slot. The guide pin is within the first end segment when the firearm is in a battery configuration.

In some embodiments of the disclosure, a method is disclosed for reducing a dimensional clearance of an adjustable firearm stock, including: (a) inserting a buffer tube into a bore of a buttstock, the bore being configured for a clearance fit with the buffer tube, and (b) adjusting a deformable structure of the buttstock to selectively adjust a dimension of the bore and to define a close sliding fit between the buffer tube and the bore, the close sliding fit enabling translation of the buffer tube within the bore along an actuation axis of the buffer tube while reducing lateral play between the buffer tube and the dimension of the bore.

DETAILED DESCRIPTION

Figure 1:
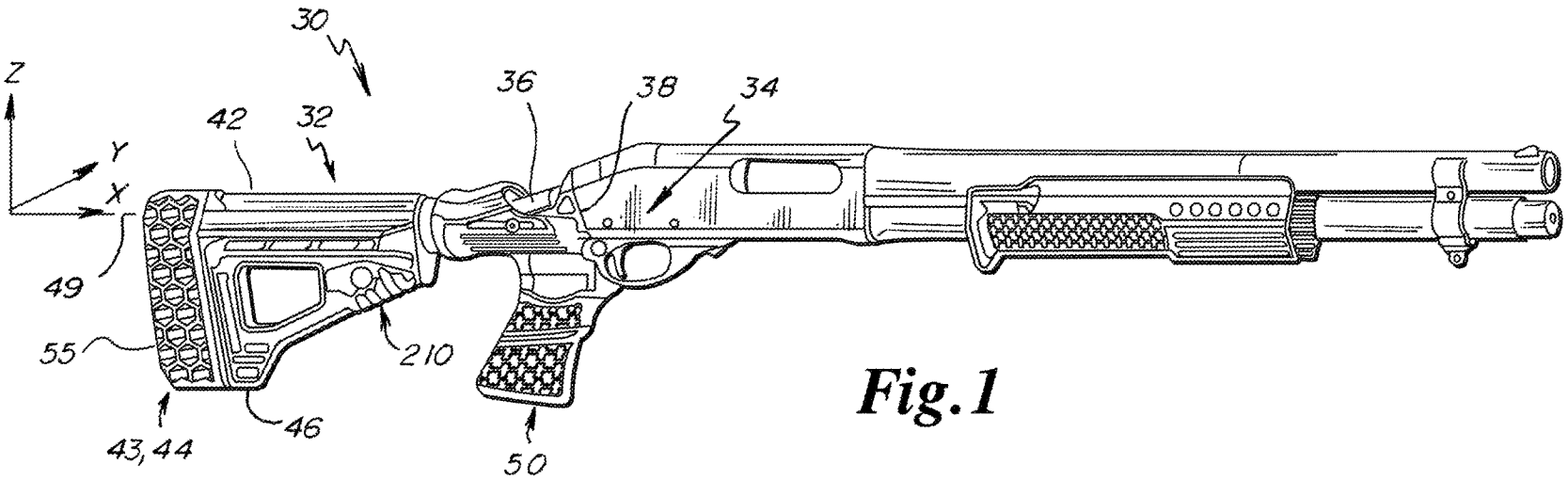
FIG. 1 is a perspective view of a modified firearm utilizing a recoil reduction system in an embodiment of the disclosure.

Referring to FIG. 1, a modified firearm 30 implementing a recoil reduction system 32 is depicted in an embodiment of the disclosure. The firearm 30 includes a receiver 34 of a standard firearm, for example a Remington Model870™ Wingmaster® (depicted). The recoil reduction system 32 includes a slide member 36 having a front or distal end 38 configured for mounting to the specific receiver 34 and operatively coupled to a buttstock 42. A butt pad assembly 43 is operatively coupled to a rear or proximal end 46 of the buttstock 38. In various embodiments, the butt pad assembly 43 includes an open cell butt pad 44, as depicted in FIG. 1.

A biasing element 48 (FIG. 2) is operatively coupled with the slide member 36 and the buttstock 42 to exert a biasing force therebetween, thereby urging the slide member 36 forward relative the buttstock 42. In one embodiment, the recoil reduction system 32 includes a hand grip assembly 50 mounted to the buttstock 42, the slide member 36 extending into the hand grip assembly 50 and being translatable along an actuation axis 49. In one embodiment, the biasing element 48 is housed in the hand grip assembly 50.

Figure 2:
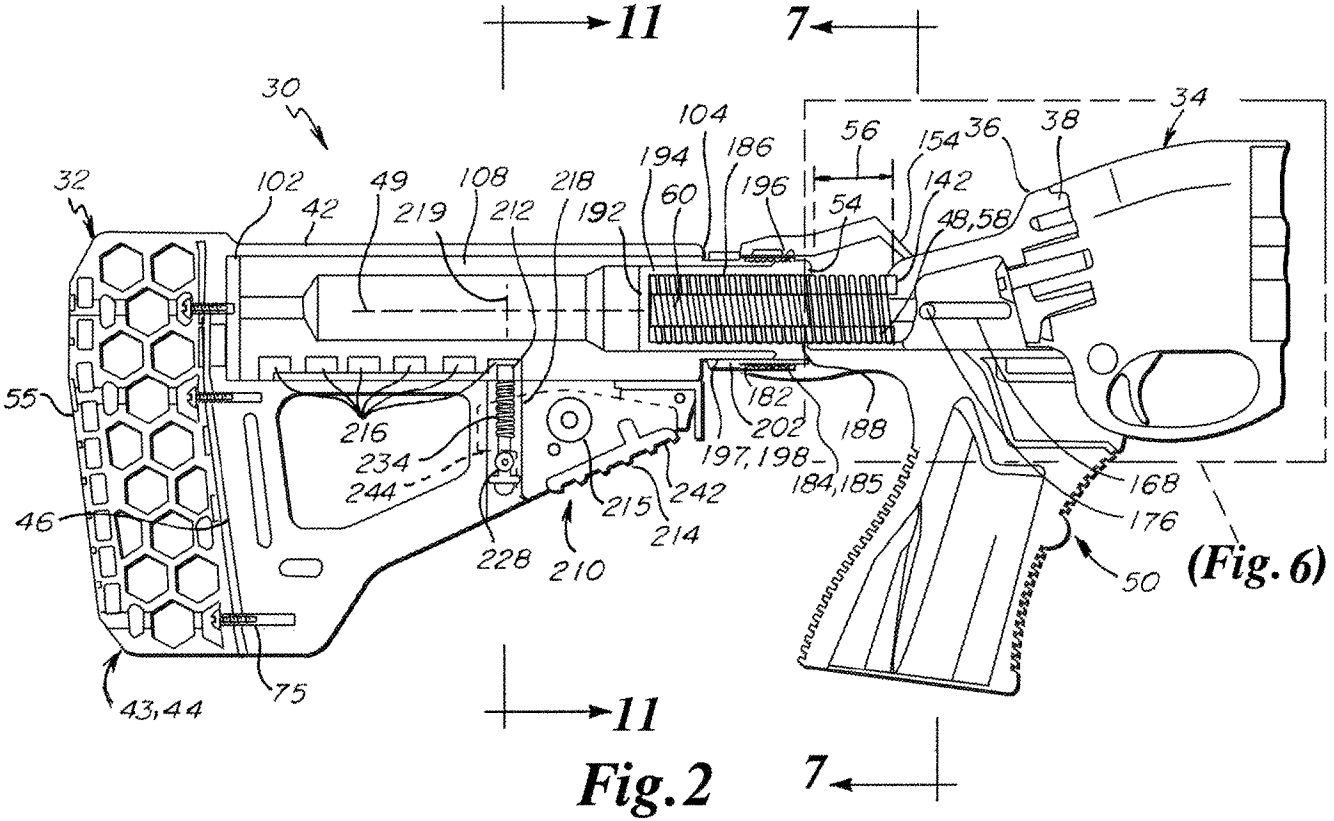
FIG. 2 is a sectional view of the recoil reduction system of FIG. 1 in a battery configuration in an embodiment of the disclosure.
Figure 3:
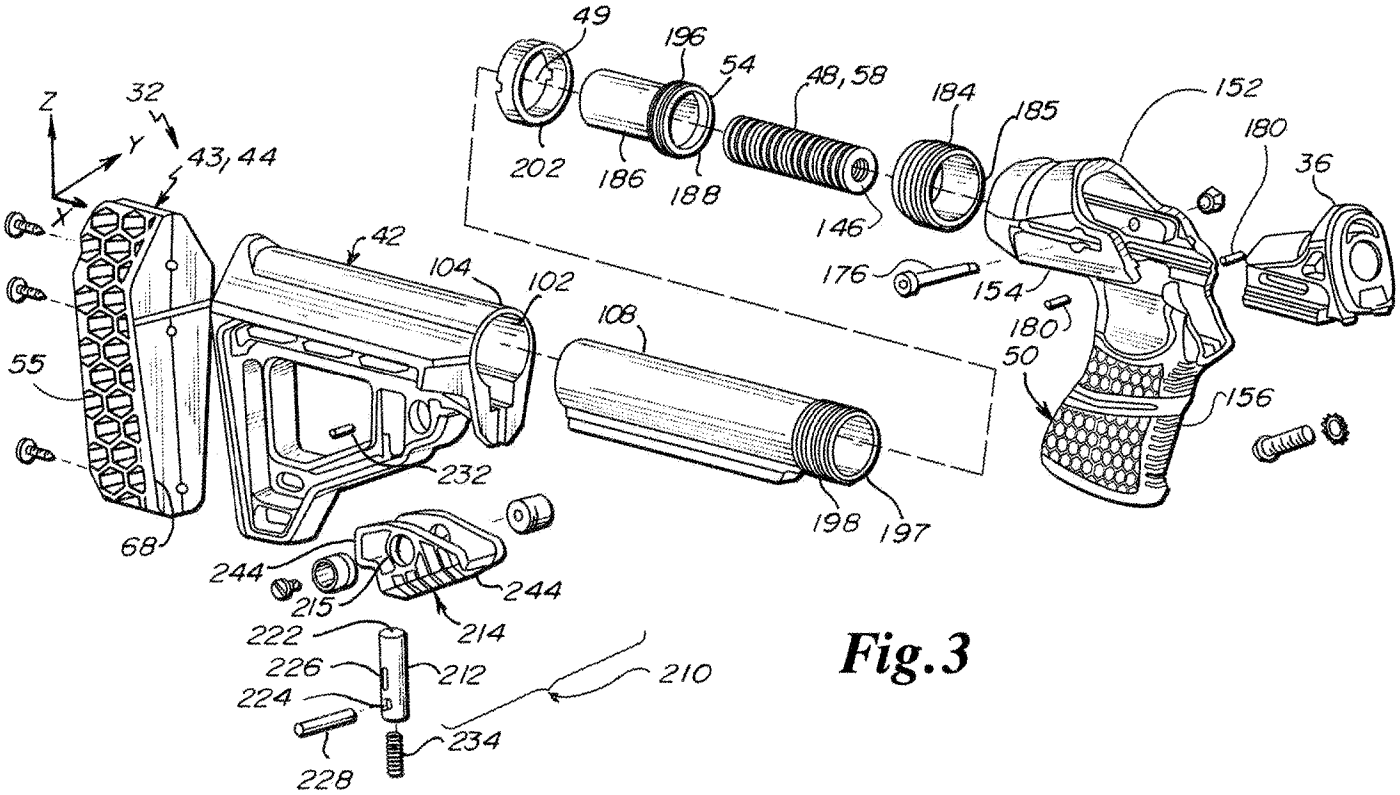
FIG. 3 is an exploded view of the recoil reduction system of FIG. 1 in an embodiment of the disclosure.

Referring to FIGS. 2 and 3, the recoil reduction system 32 is presented in an embodiment of the disclosure. In one embodiment, the recoil reduction system 32 includes a rearward or proximal stop 54 that limits the rearward or proximal travel of the slide member 36 relative to the buttstock 36 during firing of the modified firearm 30. (In the depicted embodiment, the proximal stop 54 is a distal end of a spring tube 186, described in greater detail below.) Herein, "proximal" refers to a relative direction or location that is towards a shouldered face 55 of the butt pad assembly 43, while "distal" refers to a relative direction or location that is away from the shouldered face 55.

A maximum bias member displacement 56 (FIG. 2) along the actuation axis 49 is thereby defined between the proximal stop 54 and the slide member 36 when in a battery configuration. In various embodiments, the biasing element 48 is configured for a substantially linear spring rate over the maximum bias member displacement 56. In various embodiments, the spring rate is in the range of 120 to 200 lbf/in inclusive. (Herein, a range that is said to be "inclusive" includes the end point values of the stated range, as well as the values between the end point values.) In some embodiments, the spring rate is in the range of 150 to 170 lbf/in inclusive.

In various embodiments, the biasing element 48 comprises a coiled spring 58. In some embodiments, the biasing element 48 also includes a second spring 60 nested within the coiled spring 58. By nesting springs in this manner, the springs act in parallel, providing a stiffer combined spring rate than either one of the springs 58, 60. In one non-limiting example, the coiled spring 58 is an ISO-204 die spring type having a spring rate of 25 N/mm and the second spring 60 is an ISO-203 die spring type having a spring rate of approximately 3.2 N/mm, for a combined spring rate of approximately 28 N/mm. Such springs are commercially available from, for example, Associated Spring Raymond of Maumee, Ohio, U.S.A. The coil spring(s) 58, 60 may be made of any suitable material available to the artisan, including carbon steel or a high resilience polymer. In other embodiments, the biasing element 48 includes some other suitably elastic member, such as a rubber cylinder (not depicted).

Figure 4:
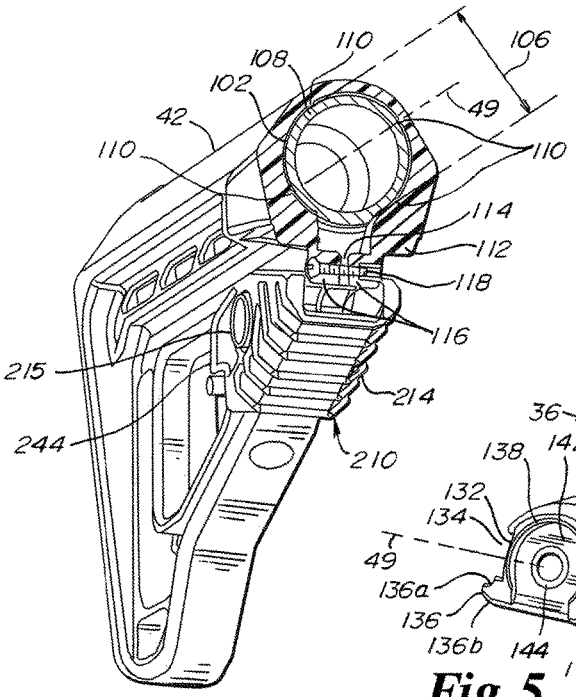
FIG. 4 is a front perspective sectional view of a buttstock and a buffer tube in assembly in an embodiment of the disclosure.

Referring to FIG. 4, a sectional view of the buttstock 42 with a buffer tube 108 disposed therein is depicted in an embodiment of the disclosure. In the depicted embodiment, the buttstock 42 defines a longitudinal bore 102 that extends along the actuation axis 49 and is accessible from a distal end 104 (FIG. 2) of the buttstock 42. The longitudinal bore 102 defines a dimension 106 proximate the distal end 104 of the buttstock 42, such as a bore diameter or, as depicted, a minimum diametrical clearance defined by ribs 110 that extend radially inward from the wall of the bore 102 toward the actuation axis 49. In the depicted embodiment, the buffer tube 108 is disposed within the longitudinal bore 102. The dimension 106 defines a clearance fit between the longitudinal bore 102 and the buffer tube 108.

In some embodiments, a deformable structure 112 is located proximate the distal end 104 of the buttstock 42. In one embodiment, the deformable structure 112 includes a longitudinal through-slot 114 defined proximate the distal end 104 of the buttstock 42, the longitudinal through-slot 114 being at least partially defined by opposing laterally-facing sides 116. Also, the deformable structure 112 may be unitary with the buttstock 42. A fastener 118 may be arranged to draw the opposing laterally-facing sides 116 towards each other to reduce the dimension 106 of the longitudinal bore 102. Herein, "longitudinal" is defined as being in a direction that is parallel to the actuation axis 49, whereas "lateral" is defined as being in a direction that is perpendicular to the actuation axis 49.

In assembly, the buffer tube 108 is slid into the longitudinal bore 102. The fastener 118 is adjusted so that the deformable structure 112 provides a close sliding fit between the buffer tube 108 and the dimension 106 of the longitudinal bore 102. The close sliding fit enables the buffer tube 108 to readily translate within the longitudinal bore 102 along the actuation axis 49, yet eliminate perceptible lateral play between the buffer tube 108 and the dimension 106 of the bore 102.

Functionally, the adjustment capability of the deformable structure 112 compensates for fabrication tolerances of the longitudinal bore 102 or, when utilized, ribs 110. For example, a buttstock 42 that comprises a molded polymer material may be subject to large dimensional variations. Because of the adjustment capability of the deformable structure 112, the dimension 106 of the longitudinal bore 102 is deliberately oversized in some embodiments so that the buffer tube 108 does not bind within the longitudinal bore 102, and the adjustment made as described above to reduce the clearance and eliminate perceptible lateral play between the buffer tube 108 and the bore 102. That is, the close sliding fit eliminates rattling between the buffer tube 108 and the buttstock 42 while enabling the buffer tube 108 to be translated with in the bore 102 of the buttstock 42.

Furthermore, the adjustment may be a one-time adjustment, or at least one that requires infrequent adjustment. Unlike prior art stocks that utilize an engagement lever that must be disengaged every time the effective length of the stock is changed, the disclosed deformable structure 112 does not have to be disengaged to change the effective length of the stock. This enables stock length adjustment with fewer steps and with fewer mechanical components.

In some embodiments, the recoil reduction system 32 is provided as part of a kit for retrofitting to an existing firearm. In various embodiments, instructions for assembly, adjustment, and operation of the recoil reduction system are provided on a tangible medium, the instructions being based on assembly, adjustment, and operation of the recoil reduction system 32 as provided herein. Herein, a "tangible medium" includes a paper document and/or a computer readable medium, such as a compact disk, flash drive, or internet-accessible server. In all instances, the tangible medium provides instructions that are non-transitory.

Figure 5:
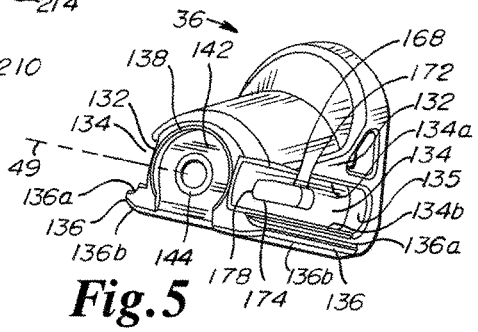
FIG. 5 is a perspective view of a slide member in an embodiment of the disclosure.

Referring to FIG. 5, the slide member 36 is depicted in isolation in an embodiment of the disclosure. The slide member 36 includes opposing lateral faces 132 (i.e., faces that face in a lateral direction in opposite directions), each lateral face 132 defining an elongate channel 134 that extends parallel to the actuation axis 49, the elongate channel 134 defining a distal end 135. The elongate channel 134 further defines upper and lower surfaces 134*a* and 134*b*, respectively, that face into the channel 134.

In some embodiments, each lateral face 132 of the slide member 36 further includes an elongate protrusion 136 disposed adjacent the respective channel 134 that is elongate in the direction of the actuation axis 49. Each elongate protrusion 136 projects laterally outward from the slide member 36 and extends parallel to the actuation axis 49 and also defines an upper surface 136*a* and a lower surface 136*b*.

The slide member 36 may also include a ridge 138 that projects rearward and partially surrounds a rearward face 142 of the slide member 36. In some embodiments, the rearward face 142 also includes a raised portion 144 that is also partially surrounded by the ridge 138, the raised portion 144 being substantially concentric about the actuation axis 49. The ridge 138 and the raised portion 144 of the rearward face 142, in certain embodiments, cooperate to capture a distal end 146 of biasing element 48 (e.g., coil spring 58) within the slide member 36. The ridge 138 may also serve as a rearward stop for the slide member 36 that contacts an obstruction to stop rearward travel of the slide member 36 relative to the buttstock 42.

A pair of canted guide slots 168 are formed in the slide member 36, one each at an inward face of each channel 134, and each defining a mirror image of the other about the actuation axis 49. In some embodiments, a forward portion 172 of each canted guide slot 168 is substantially parallel to the actuation axis 49, while a rearward portion 174 of each canted guide slot 168 is canted relative to the actuation axis 49. In some embodiments, the canted guide slots are through-slots. A guide pin 176 may be disposed through the hand grip assembly 50 and the canted guide slots 168 of the slide member 36, the guide pin 176 being anchored on each end to opposing faces of the hand grip assembly 50.

Figure 6:
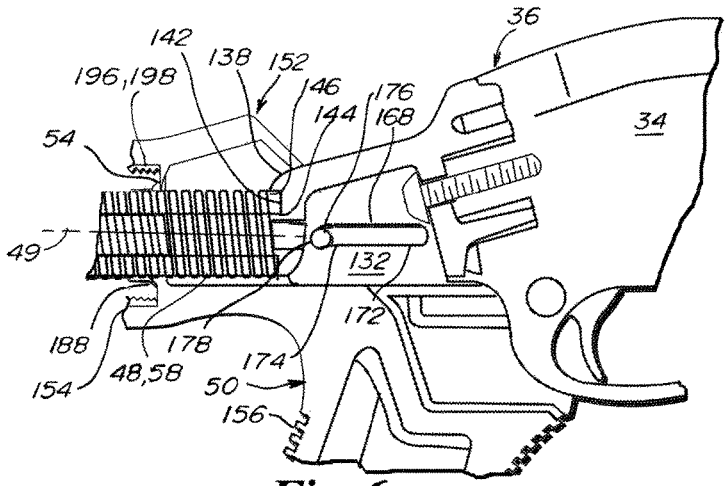
FIG. 6 is a sectional view of a slide member in assembly with the recoil reduction system of FIG. 1 in an embodiment of the disclosure.
Figure 7:
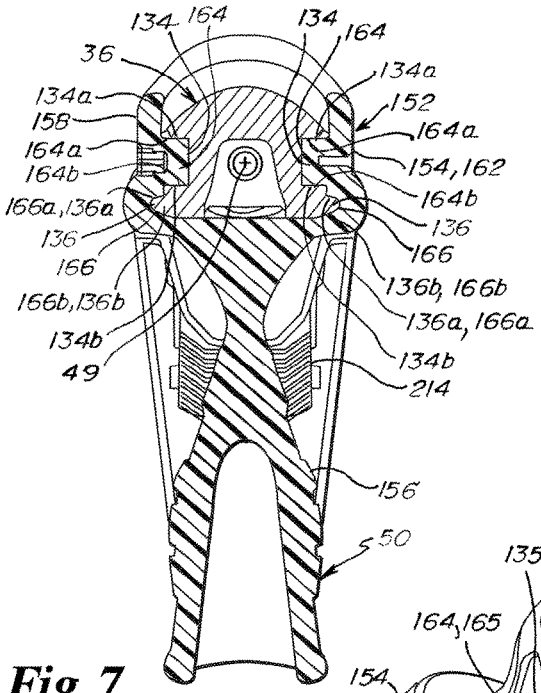
FIG. 7 is a front sectional view of a hand grip assembly and a slide member in assembly in an embodiment of the disclosure.

Referring to FIGS. 6 and 7, the slide member 36 is depicted in assembly with the hand grip assembly 50 in an embodiment of the disclosure. In the depicted embodiment, the hand grip assembly 50 includes a housing 152 with a body portion 154 and a grip portion 156, the grip portion 156 depending from the body portion 154. The body portion 154 further includes opposed lateral sides 158 and 162, each lateral side 158, 162 including a rail 164 that projects inward toward the actuation axis 49 and extends parallel to the actuation axis 49. Each rail 164 defines an upper surface 164*a* and a lower surface 164*b* that face the upper and lower surfaces 134*a* and 134*b* of the channel 134.

Each of the rails 164 are slidably engaged within a respective one of the channels 134 defined on the slide member 36. In one embodiment, the rails 164 and channels 134 are dimensioned so that a distal end 165 (best seen in FIG. 8) of each rail 164 provides a proximal stop that limits the rearward or proximal travel of the slide member 36 relative to the buttstock 42 during a recoil event. That is, in such embodiments, if the slide 36 and channels 134 formed thereon are translated far enough backwards, the distal ends 135 of the channels 134 contact the distal ends 165 of the rails 164 to define the proximal extent of the rearward stroke of the slide member 36.

In the depicted embodiment, the body portion 154 of the housing 152 further defines a pair opposed grooves 166, each disposed adjacent a respective one of the rails 164 of the body portion 154. Each groove 166 defines an upper surface 166*a* and a lower surface 166*b* that and is positioned and dimensioned so that a respective one of the elongate protrusions 136 of the slide member 36 will slide longitudinally within the groove 166.

Figure 8:
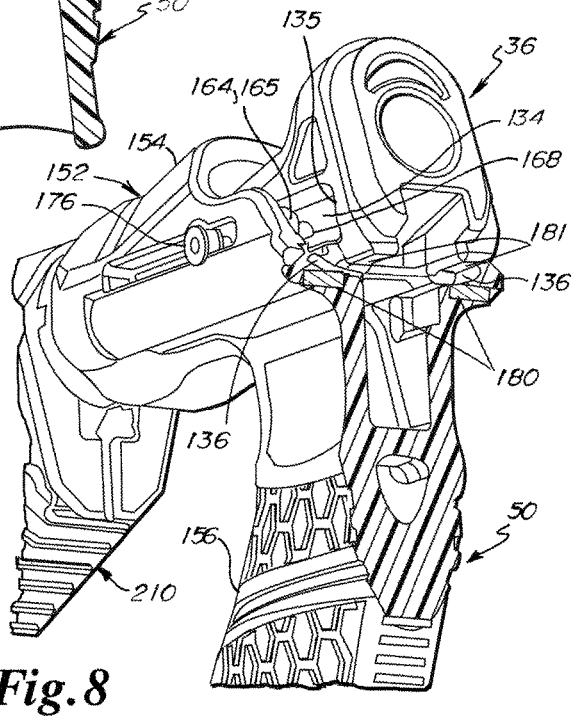
FIG. 8 is a cutaway view of the recoil reduction system of FIG. 2 utilizing skid projections in an embodiment of the disclosure.

Referring to FIG. 8, a pair of skid projections 180 imbedded in the hand grip assembly 50 are depicted in an embodiment of the disclosure. The skid projections 180 may comprise a pair of dowel pins (depicted) imbedded in the hand grip assembly 50 and positioned to engage the elongate protrusions 136 of the slide member 36 when the recoil reduction system 32 is in the battery configuration. Alternatively, the skid projections 180 comprise protrusions that are integrally formed in the grooves 166. In one embodiment, the slide member defines relief recesses 181 that are distal to the elongate protrusions 136.

Functionally, the guide pin 176 defines the rearward or "battery" position of the recoil reduction system 32 relative to the receiver 34, and guides the slide member 36 through an actuation path during a recoil event. In the battery configuration, the guide pin 176 is registered against rearward ends 178 of the canted guide slots 168 by the biasing element 48. The canted or rearward portion 174 of the canted guide slot 168 causes the slide member 36 to be slightly elevated relative to the actuation axis 49 within the hand grip assembly 50 when the recoil reduction system 32 is in the battery configuration. The elevation may be characterized as an offset 179, best seen in FIG. 9A. The elevation causes the lower surfaces 164*b* of the rails 164 of the hand grip assembly 50 to register against the lower surfaces 134*b* of the channels 134 of the slide member 36, and the upper surfaces 136*a* of the elongate protrusions 136 of the slide member 36 to register against the upper surfaces 166*a* of the grooves 166 of the hand grip assembly 50. For embodiments utilizing the skid projections 180, the engagement between the slide member 36 and the skid projections 180 further augments the offset 179 of the slide member 36. The registration of the surfaces 134*b*, 164*b* and 136*a*, 166*a* against each other reduces the looseness or play between the hand grip assembly 50 and the slide member 36 when the recoil reduction system 32 is in the battery configuration.

In an alternative embodiment, the canted guide slots 168 may be formed on the housing (not depicted) with circular apertures (not depicted) formed on the slide member 36 for holding the guide pin 176. In such an embodiment, the slide member 36 would carry the guide pin 76 along the canted guide slots of the hand grip assembly 50, to the same effect as described above.

Figure 9A:
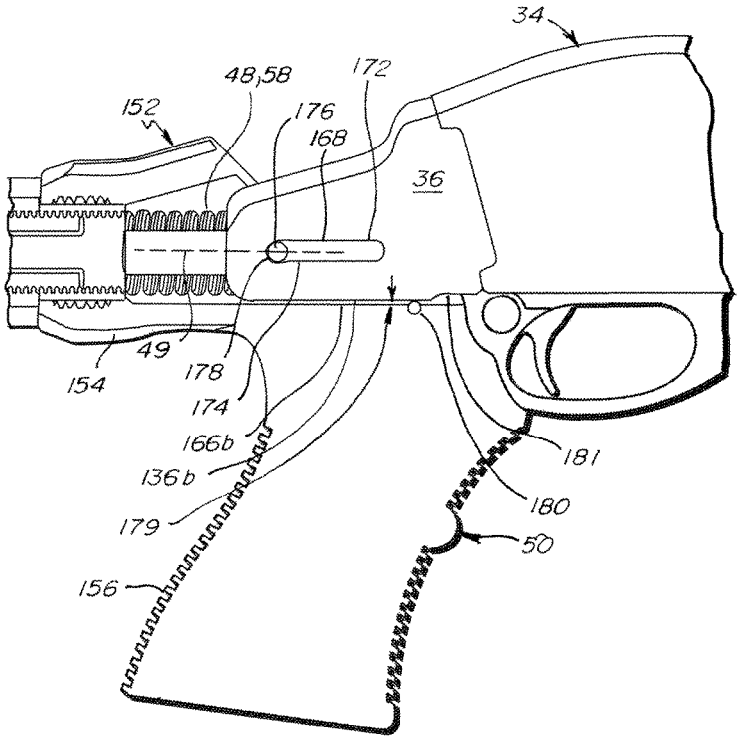
FIGS. 9A and 9B are sectional views of the recoil reduction system of FIG. 2 utilizing a canted guide slot in (A) a battery configuration and (B) during recoil in an embodiment of the disclosure.
Figure 9B:
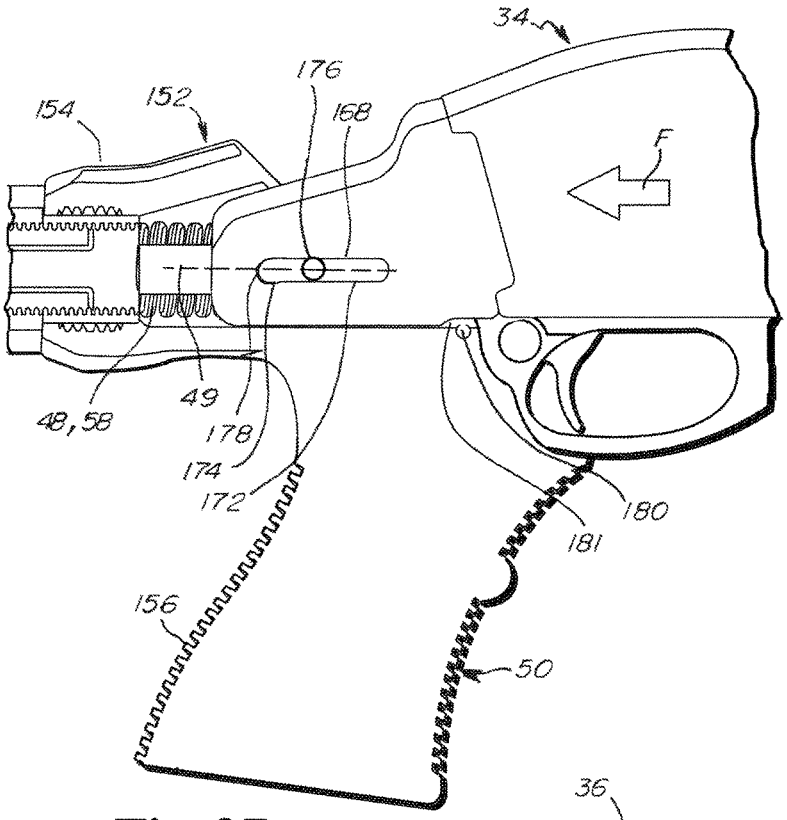

Referring to FIGS. 9A and 9B, the dynamic between the slide member 36 and the hand grip assembly 50 is depicted in an embodiment of the disclosure. In the battery configuration (FIG. 9A), the guide pin 176 is registered against the rearward end 178 and is within in the canted or rearward portion 174 of the canted guide slot 168. Also in the battery configuration, the slide member 36 is resting on the skid projections 180. As described above, this causes the slide member 36 to be elevated relative to the actuation axis 49 and the attendant registration between the surfaces 134*b*, 164*b* and 136*a*, 166*a*. The offset 179 in FIG. 9B represents a gap between the lower surfaces 136*b* of the elongate protrusions 136 and the lower surfaces 166*b* of the groove 166 that is present when the slide member 36 is elevated relative to the actuation axis 49.

Upon discharge of the firearm (FIG. 9B), an impulse force F is exerted on the slide member 36 by the receiver 34 during the recoil action. The canted guide slots 168 of the slide member 36 translate rearwardly over the guide pin 176, causing the pin 176 to enter the forward portions 172 of the canted guide slots 168 that are parallel to the actuation axis 49. For embodiments utilizing the skid projections 180, when the slide member 36 is thrust rearward in a recoil event, the relief recesses 181 pass over the skid projections 180, thereby causing the slide member 36 to disengage from the skid projections 180. These actions effectively eliminate the offset 179 imposed by the canted portion of the slot and, when utilized, imposed by the skid projections 180, which in turn causes the lower surfaces 164*b* of the rails 164 and/or the lower surfaces 136*b* of the elongate protrusions 136 to disengage with the lower surfaces 134*b* of the channels 134 and/or grooves the upper surfaces 166*a* of the grooves 166, respectively. The disengagement enables the slide member 36 to translate more freely within the hand grip assembly 50 as the pin reciprocates through the forward portions 172 of the canted guide slots 168 during a recoil event. Note that the offset 179 is not present in FIG. 9B, indicating that the surfaces 136*b* and 166*b* are in sliding contact with each other.

In further reference to FIGS. 2 and 3, the hand grip assembly 50 further defines a rearward opening 182. In one embodiment, a threaded insert 184 including internal threads 185 is molded into the rearward opening 182 of the hand grip assembly 50. In one embodiment, a spring tube 186 is disposed in the threaded insert 184, the spring tube 186 having an open forward end 188 and a bearing structure 192 at a rearward end 194. The bearing structure 192 may be, for example, an internal lip or flange, or a bridging structure such as a closed end (as depicted) or one or more laterally-extending rods. In the depicted embodiment, the forward end 188 includes exterior threads 196 that threadably engage with the threaded insert 184. The biasing element 48 is disposed in the spring tube 186 and extends into the rearward portion of the hand grip assembly 50, the biasing element 48 engaging both the bearing structure 192 of the spring tube 186 and a rearward face 142 of the slide member 36.

A front end portion 197 of the buffer tube 108 includes external threads 198 that mate with the internal threads 185 of the threaded insert 184 of the hand grip assembly 50. A castle nut 202 also engages the external threads 198 of the buffer tube 108, so that, when tightened against the hand grip assembly 50, the castle nut 202 imparts an axial load between the external threads 198 of the buffer tube 108 and the internal threads 185 of the threaded insert 184. During assembly, a bonding paste, such as LOCTITE®, may be applied between the external threads 198 of the buffer tube 108 and the internal threads 185 of the threaded insert 184. The bonding paste and the axial force exerted by the castle nut 202 act to resist rotation between the buffer tube 108 and the hand grip assembly 50.

Figure 10:
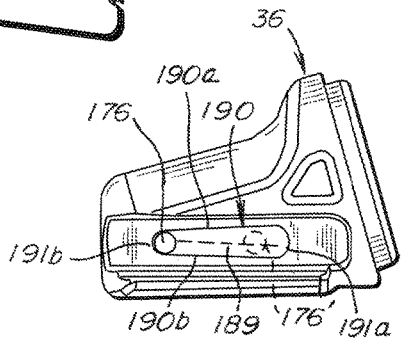
FIG. 10 is a side elevational view of a slide member in an embodiment of the disclosure.

Referring to FIG. 10, an alternative embodiment of the slide member 36 is presented in an embodiment of the disclosure. Instead of the canted guide slot 168, a flared through-slot 190 is formed in the slide member 36. The flared through-slot 190 is elongate along an axis 189 that is parallel to the actuation axis, and is defined by opposing boundaries 190*a* and 190*b*, a forward end 191*a*, and a rearward end 191*b*. The rearward end 191*b* may be shaped and dimensioned to accommodate the contour of the guide pin 176, akin to the rearward end 178 of the canted guide slot 168. In various embodiments, the rear end 191*b* be located to elevate the slide member 36 relative to the actuation axis when the recoil reduction system 32 is in the battery configuration, as described above attendant to FIG. 9A. Accordingly, in various embodiments, the flared through-slot 190 provides the same rattle-abatement function as the canted guide slot 168.

During a recoil event, the slide member 36 is translated rearward, dislodging the guide pin 176 from the rearward end 191*b* of the flared slot 190. In some embodiments, the guide pin 176 translates freely between and without contacting the opposing boundaries 190*a* and 190*b* of the flared through-slot 190 during the recoil stroke. A representative position of the guide pin 176 during the recoil stroke is depicted in phantom at 176'. The location of the guide pin 176 within the flared through-slot 190 is determined by other alignment and guide mechanisms of the recoil reduction system 32, such as the channels 134 and rails 164, and/or the protrusions 136 and grooves 166 (FIG. 7).

Figure 11:
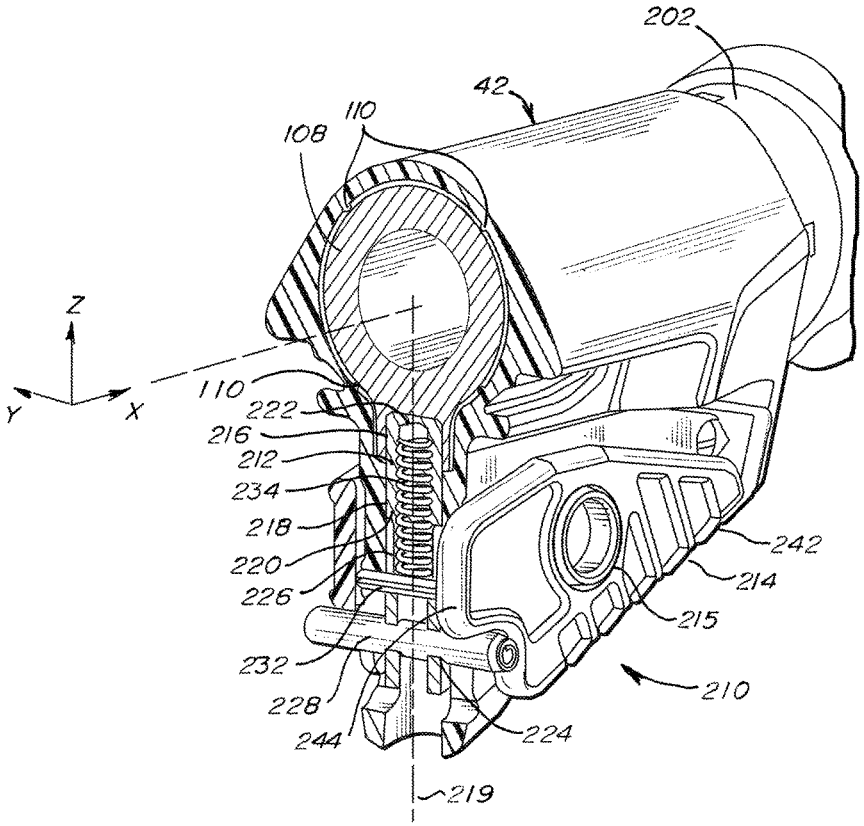
FIG. 11 is a partial sectional view of a stock length adjustment mechanism in an unactuated state in an embodiment of the disclosure.

Referring to FIG. 11 and again to FIGS. 2 and 3, a stock length adjustment mechanism 210 for the recoil reduction system 32 is depicted in an embodiment of the disclosure. The stock length adjustment mechanism includes an adjustment pin 212, an adjustment lever 214 coupled to the buttstock 42 about a pivot 215, and a plurality of adjustment notches 216 (FIG. 2) formed on the buffer tube 108. Portions of the adjustment lever 214 are outlined in FIG. 2 in phantom. In one embodiment, the adjustment pin 212 is housed within a bore 218 defined in the buttstock 42, the bore 218 defining a pin actuation axis 219 that is parallel to the z-axis. The adjustment pin 212 and bore 218 are dimensioned so that the adjustment pin 212 can slide within the bore 218. In various embodiments, the adjustment pin 212 comprises a hollow tube 220 with a closed or restricted diameter end portion 222. The hollow tube 220 may define a circular through hole 224 and a slotted through hole 226.

In various embodiments, a cross pin 228 is disposed in the circular hole 224 of the adjustment pin 212, the cross pin 228 extending parallel to the y-axis. In some embodiments, an anchor pin 232 extends across the bore 218 and through the slotted through hole 226, the anchor pin 232 being perpendicular to the pin actuation axis 219 and oriented in a direction parallel to the y-axis. The anchor pin 232 is secured on both ends to the buttstock 42. In the depicted embodiment, as spring 234 is disposed in the hollow tube 220, captured between the end portion 222 and the anchor pin 232.

In the depicted embodiment, the bore 218 is aligned with a selected one of the plurality of adjustment notches 216, such that the adjustment pin 212 extends out of the bore 218 and into selected notch 216. In FIG. 2, the adjustment pin 212 is in the forward-most of the adjustment notches 216, so that the effective length of the recoil reduction system 32 is at its shortest.

In operation, to change the length adjustment of the recoil reduction system 32, a forward end 242 of the adjustment lever 214 is pressed toward the buttstock 42, causing the lever 214 to rotate about pivot 215 so that a rearward end 244 of the lever rotates away from the buttstock 42. The rotation causes the rearward end 244 of the adjustment lever 214 exerts a force on the cross pin 228 which transfers to the adjustment pin 212, so that the adjustment pin 212 becomes dislodged from the adjustment notch 216. With the adjustment pin 212 dislodged from the adjustment notch 216, the buffer tube 108 may be slid longitudinally within the bore 102 of the buttstock 42 to establish a different overall length of the recoil reduction system 32.

During actuation of the adjustment pin 212, the slotted through hole 226 slides over the stationary anchor pin 232 as the end portion 222 is drawn closer to the anchor pin 232. The spring 234 becomes compressed between the end portion 222 and the anchor pin 232. The compression biases the adjustment pin 212 so that, upon release of the adjustment lever 214, the adjustment pin 212 is urged back into contact with the buffer tube 108 and, perhaps after some additional positioning of the buffer tube 108 within the bore 102, into one of the adjustment notches 216.

The concept of creating an interfering engagement between the slide member 36 and the hand grip assembly 50 to reduce rattle and play when in the battery configuration can be effected by other mechanisms besides the canted guide slots 168. In various embodiments, the selectively interfering engagement is provided by a widening or narrowing of one sliding structure relative to its mating structure. Some alternative concepts and mechanisms are discussed below.

Figure 12A:
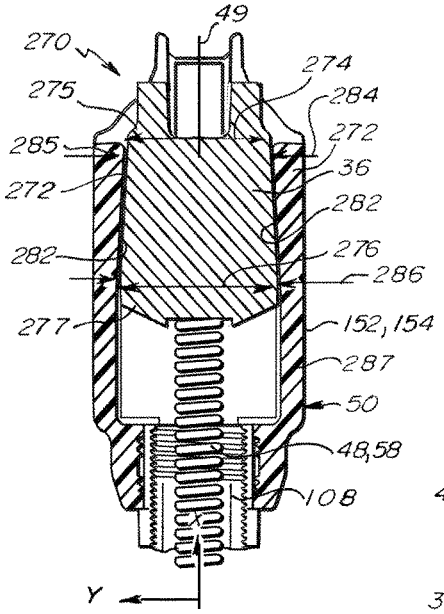
FIGS. 12A and 12B are top sectional views of a slide member in a hand grip housing in an embodiment of the disclosure.
Figure 12B:
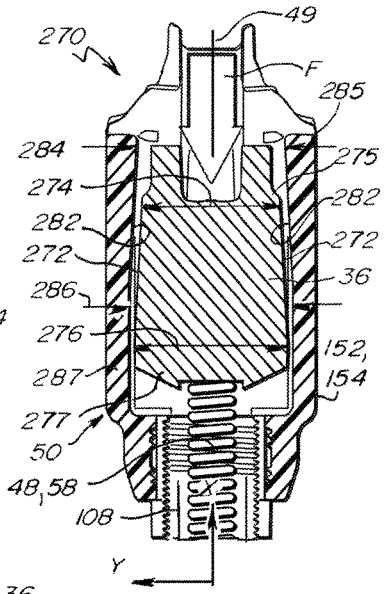

Referring to FIGS. 12A and 12B, a flared width slide system 270 is depicted in an embodiment of the disclosure. The flared width slide system 270 includes many of the same components and attributes as the recoil reduction system 32, which are indicated with same numbered numerical references. For the flared width slide system 270, the slide member 36 is modified to present flared surfaces 272 that define a slope with respect to the actuation axis 49 or, more generally, with respect to the x-axis. The flared surfaces 272 slope away from the x-axis in the proximal (negative x) direction, such that the a first width 274 defined between the flared surfaces 272 at a distal portion 275 of the slide member 36 is of smaller dimension than a second width 276 defined between the flared surfaces 272 at a proximal portion 277 of the slide member 36. Herein, a "width" refers to a dimension in the y-direction.

For the flared width slide system 270, the hand grip assembly 50, within which the slide member 36 is housed, is configured with complementary flared surfaces 282 that complement the flared surfaces 272 when in the battery configuration. That is, a first width 284 defined between the complementary flared surfaces 282 at a distal portion 285 of the body portion 154 of the housing 152 of the hand grip assembly 50 is of smaller dimension than a second width 286 defined between the complementary flared surfaces 282 at a proximal portion 287 of the body portion 154.

In various embodiments, the flared surfaces 272 of the slide member 36 is defined by one or both of the channels 134 and/or by one or both of the protrusions 136 of the slide member 36 (FIG. 7). In such embodiments, the complementary flared surfaces 282 are defined by one or both of the rails 134 and/or by one or both of the grooves 166.

Functionally, the flared surfaces 272 of the slide member 36 are registered against the flared surfaces 282 of the body portion 154 when the recoil reduction system 32 is in the battery configuration (FIG. 12A). In the battery configuration, the flared surfaces 272, 282 are maintained in contact by the force exerted on the slide member 36 by the biasing element 48 (e.g., coil spring 58). During a recoil event (FIG. 12B), the impulse force F pushes the slide member 36 in the proximal direction, causing the flared surface 272 of the slide member 36 to disengage from the complementary flared surface 282 of the body portion 154. Accordingly, the tight registration of the flared surfaces 272, 282 to each other is present only in the battery configuration, when abatement of rattling and play is desired, but is not present during the recoil action when tight contact between sliding surfaces is not desired.

Figure 13A:
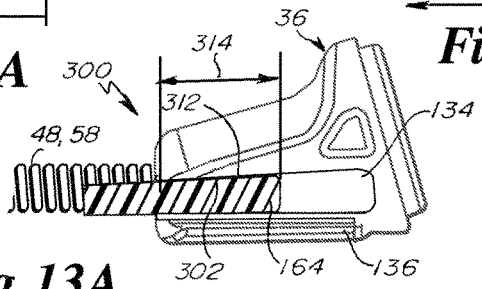
FIGS. 13A and 13*b* are side elevational views of a slide member with rails depicted in cross-section in an embodiment of the disclosure.
Figure 13B:
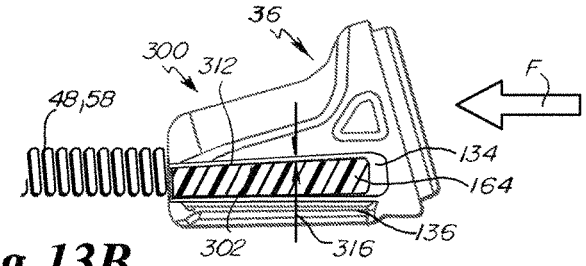

Referring to FIGS. 13A and 13B, an inclined height slide system 300 is depicted in an embodiment of the disclosure. The inclined height slide system 300 includes many of the same components and attributes as the recoil reduction system 32, which are indicated with same numbered numerical references. For the inclined height slide system 300, the slide member 36 is modified to present at least one inclined surface 302 that defines a slope relative to the actuation axis 49 or, more generally, relative to the x-direction. In the depicted embodiment, the inclined surface 302 of the slide member 36 is defined by the channel 134, such that the height of the channel 134 increases in the distal direction. Herein, the "height" of the channel 134 refers to its dimension in the z-direction. In the particular embodiment of FIGS. 13A and 13B, the upper surface 134*a* of the channel 134 defines a positive slope (increase in the z-direction) in the distal (positive x) direction to accomplish the increase in height in the distal direction. It is understood that, alternatively or in addition, the increase in the height of the channel 134 may be accomplished by defining a negative slope (decrease in the z-direction) in the distal direction on the lower surface 134*b* of the channel 134. Furthermore, the inclined surface 302, while depicted as being linear, is not so limited. That is, the inclined surface 302 may be curved or arcuate.

For the inclined height slide system 300, the hand grip assembly 50, within which the slide member 36 is housed, is configured with complementary inclined surface 312 that complements the inclined surface 302 when in the battery configuration. That is, the inclined surfaces 302, 312 are configured so that the inclined surface 302 is firmly registered against inclined surface 312 when the recoil reduction system 32 is in the battery configuration. In the depicted embodiment, the heights of the channel 134 and heights of the rail 164 are matched across a length 314 in the x-direction.

In the depicted embodiment, the inclined surfaces 302, 312 are defined by the channel 134 and the rail 164, respectively. Alternatively or in addition, other surfaces of the slide member 36 and body portion 154 can be utilized to define complementary inclined surfaces. For example, inclined surfaces can be utilized between the elongate protrusions 136 and grooves 166 mutatis mutandis.

Functionally, the inclined surface 302 of the slide member 36 is registered against the inclined surface 312 of the rail 134 when the recoil reduction system 32 is in the battery configuration (FIG. 13A). In the battery configuration, the inclined surfaces 302, 312 are maintained in contact by the force exerted on the slide member 36 by the biasing element 48 (e.g., coil spring 58). During a recoil event (FIG. 13B), the impulse force F pushes the slide member 36 in the proximal direction, causing the inclined surface 302 of the slide member 36 to disengage from the complementary inclined surface 312 of the rail 164. The disengagement is exemplified in FIG. 13B by a gap 316 between the inclined surfaces 302, 312. Accordingly, the tight registration of the flared surfaces 302, 312 to each other is present only in the battery configuration, when abatement of rattling and play is desired, but is not present during the recoil action when tight contact between sliding surfaces is not desired.

References to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims for the embodiments of the inventions, it is expressly intended that the provisions of 35 U.S.C. 112(f) are not to be invoked unless the specific terms "means for" or "step for" are recited in the respective claim.

The invention claimed is:

1. A recoil abatement system for a firearm, comprising:

a housing;

a slide member translatable within said housing along an actuation axis, said slide member being configured for coupling to a receiver;

a canted guide slot defined on a lateral face of one of said housing and said slide member, said canted guide slot having a first end segment that is canted relative to a direction of said actuation axis; and a guide pin extending laterally from the other of said housing and said slide member, said guide pin extending into said canted guide slot, wherein said guide pin is within said first end segment when the recoil abatement system is in a battery configuration; and wherein said guide pin and said canted guide slot are configured to laterally offset said slide member relative to said actuation axis so that said slide member registers against said housing when the recoil abatement system is in said battery configuration.

2. The recoil abatement system of claim 1, comprising:

a buttstock defining a longitudinal bore;

a biasing element operatively coupled with said buttstock and said slide member;

and a buffer tube configured for insertion into said longitudinal bore along said actuation axis, said longitudinal bore being configured for a clearance fit with said buffer tube, wherein said buttstock includes a deformable structure adapted to selectively reduce a dimension of said longitudinal bore to configure said buttstock for a close sliding fit between said longitudinal bore and said buffer tube.

3. The recoil abatement system of claim 1, wherein said dimension is a diameter of said longitudinal bore about said actuation axis.

4. The recoil abatement system of claim 1, wherein said deformable structure is located proximate a distal end of said buttstock.

5. The recoil-abatement system of claim 4, wherein said deformable structure includes:

a longitudinal through slot defined proximate said distal end of said buttstock, said longitudinal slot being at least partially defined by opposing lateral sides; and a fastener arranged to draw said opposing lateral sides towards each other to reduce said dimension of said longitudinal bore.

6. The recoil abatement system of claim 1, wherein:

said buffer tube includes a plurality of recesses formed on a lateral side thereof;

said buttstock includes structure defining a lateral through passage for selective alignment with any one of said plurality of recesses; and a set pin is disposed within said lateral through-passage for selective engagement with any one of said plurality of recesses for anchoring said buffer tube to said buttstock.

7. The recoil abatement system of claim 6, comprising:

a lever pivotally mounted to said buttstock and operatively coupled with said set pin for selectively removing said set pin from said any one of said plurality of recesses.

8. The recoil abatement system of claim 7, further comprising a biasing element coupled to said set pin for biasing said set pin to engage with said buffer tube.

9. The recoil abatement system of claim 1, comprising a butt pad coupled to a proximal end of said buttstock, wherein said butt pad defines an open cell structure that is exposed to ambient air.

10. The recoil abatement system of claim 9, wherein any one of said buttstock, said butt pad, and said biasing element is formed of a polymer material.

11. The recoil abatement system of claim 1, wherein said longitudinal bore is defined by a bore wall in the buttstock, wherein the bore wall includes at least one rib that protrudes toward said actuation axis, said dimension of said longitudinal bore being referenced from said at least one rib.

12. The recoil abatement system of claim 1, wherein said deformable structure is unitary with said buttstock.

13. The recoil abatement system of claim 1, wherein:

one of said housing and said slide member defines a channel and the other of said housing and said slide member includes a rail disposed in said channel, said channel and said rail extending parallel to said actuation axis; and said rail is biased against a wall of said channel to register said slide member against said housing.

14. The recoil abatement system of claim 1, wherein said housing is a hand grip assembly.

15. A recoil abatement system for a firearm, comprising:

a housing;

a slide member translatable within said housing along an actuation axis, said slide member being configured for coupling to a receiver; and means for preventing rattle and play between said slide member and said housing when the recoil abatement system is in a battery configuration, wherein said means for preventing rattle and play comprises a biasing element coupled to said slide member to bias said slide member in a distal direction within said housing when the recoil abatement system is in said battery configuration;

a canted guide slot defined on a lateral face of one of said housing and said slide member, said canted guide slot having a first end segment that is canted relative to a direction of said actuation axis; and a guide pin extending laterally from the other of said housing and said slide member, said guide pin extending into said canted guide slot, wherein said biasing element exerts a biasing force against said slide member to seat said first end segment of said canted guide slot against said guide pin when the recoil abatement system is in said battery configuration, thereby offsetting said slide member relative to said actuation axis so that said slide member registers against said housing when the recoil abatement system is in said battery configuration.

16. A recoil abatement system for a firearm, comprising:

a housing;

a slide member translatable within said housing along an actuation axis, said slide member being configured for coupling to a receiver; and means for preventing rattle and play between said slide member and said housing when the recoil abatement system is in a battery configuration, wherein said means for preventing rattle and play comprises:

a biasing element coupled to said slide member to bias said slide member in a distal direction within said housing when the recoil abatement system is in said battery configuration;

a flared through-slot defined on said slide member, said flared through-slot being elongate along an axis that is parallel to said actuation axis; and a guide pin extending laterally from said housing and extending into said flared through-slot, wherein a rearward end of said flared through-slot is shaped and dimensioned to accommodate a contour of said guide pin, wherein said biasing element exerts a biasing force against said slide member to seat said rearward end of said flared through-slot against said guide pin when the recoil abatement system is in said battery configuration, thereby offsetting said slide member relative to said actuation axis so that said slide member registers against said housing when the recoil abatement system is in said battery configuration.

17. A recoil abatement system for a firearm, comprising:

a housing;

a slide member translatable within said housing along an actuation axis, said slide member being configured for coupling to a receiver; and means for preventing rattle and play between said slide member and said housing when the recoil abatement system is in a battery configuration, wherein said means for preventing rattle and play comprises:

a biasing element coupled to said slide member to bias said slide member in a distal direction within said housing when the recoil abatement system is in said battery configuration;

a first flared surface disposed on said slide member, said first flared surface defining a slope with respect to said actuation axis, said first flared surface sloping away from said actuation axis in a proximal direction, such that the a first width at a distal portion of said slide member is of smaller dimension than a second width at a proximal portion of said slide member; and a second flared surface disposed on said housing, said second flared surface defining a slope with respect to said actuation axis that is complementary to said first flared surface, wherein said biasing element exerts a biasing force against said slide member to seat said first flared surface against said second flared surface when the recoil abatement system is in said battery configuration.

18. The recoil abatement system of claim 17, wherein said first flared surface and said slide member are unitary and said second flared surface and said housing are unitary.

19. A recoil abatement system for a firearm, comprising:

a housing, a slide member translatable within said housing along an actuation axis, said slide member being configured for coupling to a receiver; and means for preventing rattle and play between said slide member and said housing when the recoil abatement system is in a battery configuration, wherein said means for preventing rattle and play comprises:

a biasing element coupled to said slide member to bias said slide member in a distal direction within said housing when the recoil abatement system is in said battery configuration;

a first inclined surface defined on said slide member, said first inclined surface defining a slope with respect to said actuation axis; and a second inclined surface defined on said housing, said second inclined surface defining a slope with respect to said actuation axis that is complementary to said first inclined surface, wherein said biasing element exerts a biasing force against said slide member to seat said first inclined surface against said second inclined surface when the recoil abatement system is in said battery configuration.

* * * * *